United States Patent [19]

Okada et al.

[11] 4,181,424

[45] Jan. 1, 1980

[54] METHOD OF AND MEANS FOR SYNCHRONOUSLY TRANSFERRING ORIGINAL AND COPYING PAPER FOR ELECTROSTATIC PHOTODUPLICATION

[75] Inventors: Tetuya Okada, Takatuki; Tadashi Umeda, Gosho; Masahiro Murakami, Shijonawate; Tatsuo Aizawa, Osaka, all of Japan

[73] Assignee: Mita Industrial Co., Ltd., Osaka, Japan

[21] Appl. No.: 915,303

[22] Filed: Jun. 12, 1978

[30] Foreign Application Priority Data

Jun. 11, 1977 [JP] Japan ..... 52-69748

[51] Int. Cl.[2] ..... G03G 15/28

[52] U.S. Cl. ..... 355/8; 271/9; 355/3 SH

[58] Field of Search ..... 355/14, 8, 11, 3 R, 355/3 SH; 271/9, 265

[56] References Cited

U.S. PATENT DOCUMENTS

| | | | |
|---|---|---|---|
| 3,672,762 | 6/1972 | Suzuki et al. | 355/8 X |
| 3,704,944 | 12/1972 | Komori et al. | 355/8 |
| 3,762,813 | 10/1973 | Fowlie et al. | 271/9 X |
| 4,009,957 | 3/1977 | Suzuki et al. | 271/9 X |

*Primary Examiner*—R. L. Moses

*Attorney, Agent, or Firm*—Wenderoth, Lind & Ponack

[57] ABSTRACT

A method of and apparatus for synchronously transferring an original and a sheet of copying paper for electrostatic photoduplication. A paper feeding device feeds the sheets of copying paper one at a time until the front edge reaches a predetermined position at a front edge stop. The sheet of copying paper is held at the predetermined position on standby for a period of time, and then a paper transfer device transfers it to move the front edge to an exposure point. At the same time an original placed on a mount is moved from a stopping point in the cycle of movement of the mount to a position in which the leading edge of the original is at an irradiation point optically aligned with the exposure point. The period of time during which the copying paper is fed from the supply, held in the predetermined position, and then moved to the exposure position is equal to the time for moving the mount for the original from a predetermined point along the path of movement of the mount to the irradiation point. Thereafter, the original is moved past the irradiation point synchronously with transfer of the copying paper past the exposure point at a predetermined rate for exposing the copying paper to the image from the original.

7 Claims, 12 Drawing Figures

METHOD OF AND MEANS FOR SYNCHRONOUSLY TRANSFERRING ORIGINAL AND COPYING PAPER FOR ELECTROSTATIC PHOTODUPLICATION

The present invention relates to a method of and a means for synchronizing the transfer of an original and copying paper for electrostatic photoduplication and, more particularly, to a method of and a means for synchronizing the arrival of an original placed on a mount at an irradiation starting point with the arrival of copying paper at an exposure starting point.

BACKGROUND OF THE INVENTION AND PRIOR ART

The transfer of an original and copying paper for electrostatic photoduplication have heretofore been synchronized by an electrical system. In this electrical system, a detector means, such as a limit switch, microswitch or the like is disposed in a required position between a copying paper inserting section and an exposure starting point in a copying paper transferring path so that copying paper transferred along the path is detected. Then, the rotation of a copying paper transferring rolls is stopped for a predetermined period of time by an electromagnetic clutch connected thereto, which is actuated by a timer. The electromagnetic clutch is then operated in accordance with the transfer of the mount for originals to drive the transfer rolls again so that the copying paper is transferred. With to such an electrical system, not only is the cost of manufacturing the copying machine high but also the electrical connection is complicated. Errors in writing during the production of copying machine are liable to occur and it is necessary that electrical tests be conducted during the production thereof. Moreover, the maintenance and inspection of the copying machine is difficult.

OBJECT AND BRIEF SUMMARY OF THE INVENTION

An object of the present invention is to eliminate the above-described drawbacks encountered in a conventional system, by synchronizing the transfer of the original and the copying paper by a mechanical means moved in accordance with the mount for the original. The characteristics of the present invention reside in the following. Copying paper is fed by aligning the front end thereof at a predetermined position so that the paper is on standby therein, during the time a period of time $T_1$ has elapsed after a mount for an original is transferred from a stopping point provided in the mount transferring path. When a period of time $T_2$ has elapsed after the lapse of the time $T_1$, the arrival of the original placed on the mount at an irradiation starting point and the arrival of the copying paper at an exposure starting point coincide. After this has occurred, the copying paper is transferred at the same speed as the mount for original so as to carry out the irradiation of the original and the exposure of the copying paper. Copying paper may be automatically fed in the following manner. The feeding of copying paper is started by paper feeding members when a period of time $To_1$, which is within the time period $T_1$, has elapsed after the starting of transfer of the mount for the original. Thus, the copying paper is transferred and the front end thereof is aligned at a predetermined position or a position where it is stopped by a stop, so that it is on standby therein, by during the time a period of time $To_2$ has elapsed after the lapse of the time $To_1$, i.e. by the time a period of time $T_1(To_1+To_2=T_1)$ has elapsed after the starting of transfer of the mount for the original. When copying paper is manually fed, it is necessary that the paper be on standby with the front end thereof in a predetermined position by the time a period of time $T_1$ has elapsed after the starting of transfer of the mount for the original. The method and apparatus according to the present invention may be applied to both of the above systems of feeding copying paper.

An embodiment of the present invention applied to an electrostatic photocopying machine will be described with reference to the accompanying drawings.

BRIEF DESCRIPTION OF THE FIGURES

Referring to FIGS. 1*a*, 1*b* and 2, reference numeral 1 denotes a mount for an original supported on a machine body 2 so that it is horizontally reciprocable on rollers (not shown), and 3 designates a frame secured to a side portion of the mount 1 and movable along the front surface of the machine body 2 with the mount 1. Reference numeral 4 denotes a chain for driving the mount 1, and the chain 4 is wrapped around sprockets 5 and 6 which are rotatably mounted on shafts provided in the machine body 2. The chain 4 is provided at a predetermined portion thereof with an engagement member 7, which is fitted in a guide recess 8 provided in the movable frame 3. Therefore, when the chain 4 is moved, the movable frame 3 is driven by the engagement member 7 which is engaged in the recess 8 in the frame 3, so as to horizontally reciprocate the mount 1. Assume that one cycle of movement of the mount 1 is represented by "A". The mount 1 begins to be moved at a predetermined point (stopping point) S in the cycle A and returns to the point S where it is stopped. In this embodiment, the stopping point S on an imaginary line as shown in FIG. 1*a* is aligned with the rear end of the mount 1.

Figure 1A:
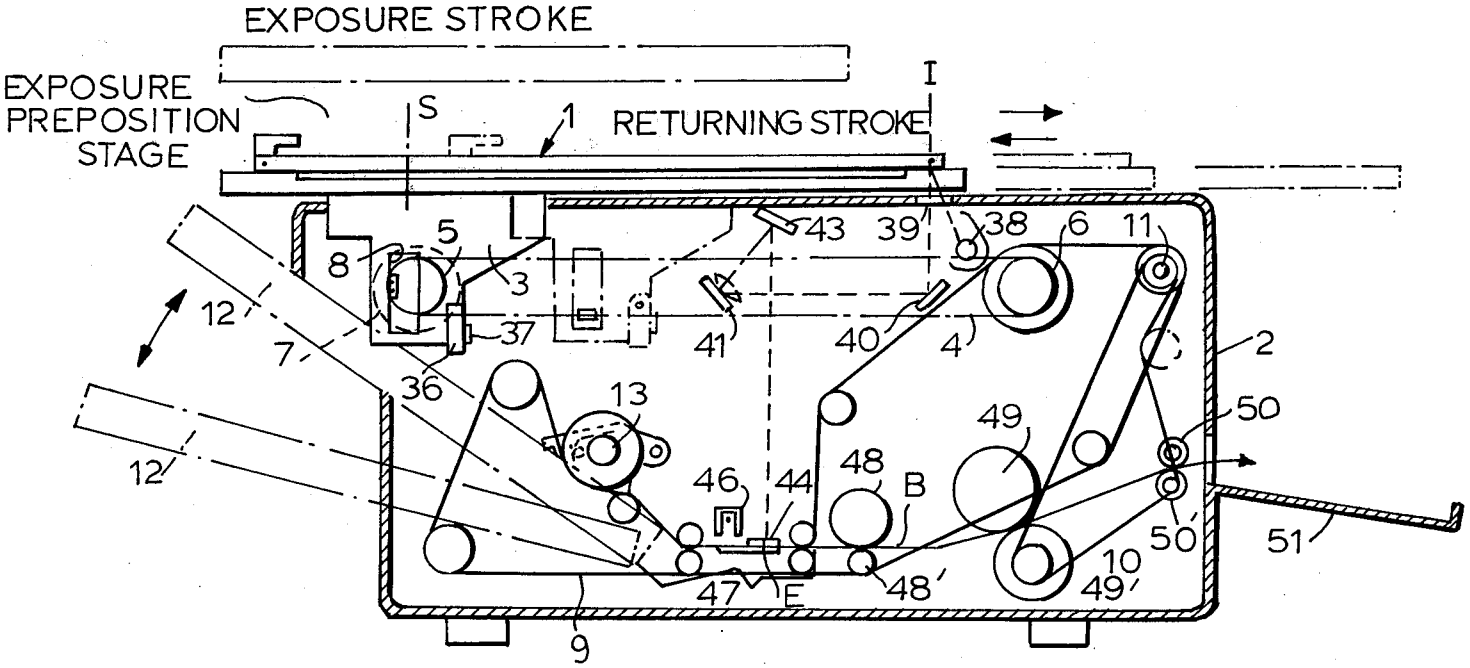
FIGS. 1*a* and 1*b* are diagrammatic sectional elevational views of an electrostatic photocopying machine to which an embodiment of the method and means according to the present invention are applied.

Reference symbol B denotes the path of copying paper, which is transferred along the path B by a plurality of rolls which are driven by chains 9 and 10. Reference numeral 11 denotes a drive motor by which the chains 9 and 10 are driven, and the driving force of the chain 9 rotates the sprocket 6 via a clutch so that the chain 4 for driving the mount 1 is actuated.

Reference numeral 12 denotes a cassette for copying paper vertically oscillatably provided in the machine body 2. When the copying paper is to be automatically fed from the cassette 12, the cassette 12 is kept inclined in the position as shown in phantom lines in FIG. 1*b*. When the copying paper is to be fed sheet by sheet by hand, the cassette 12 is moved downwardly from the above-mentioned position so as to be positioned in a lower position as shown in phantom lines in FIG. 1*a*, so that the upper surface of the cassette 12 serves as a guide for inserting paper by hands thereinto.

Figure 2:
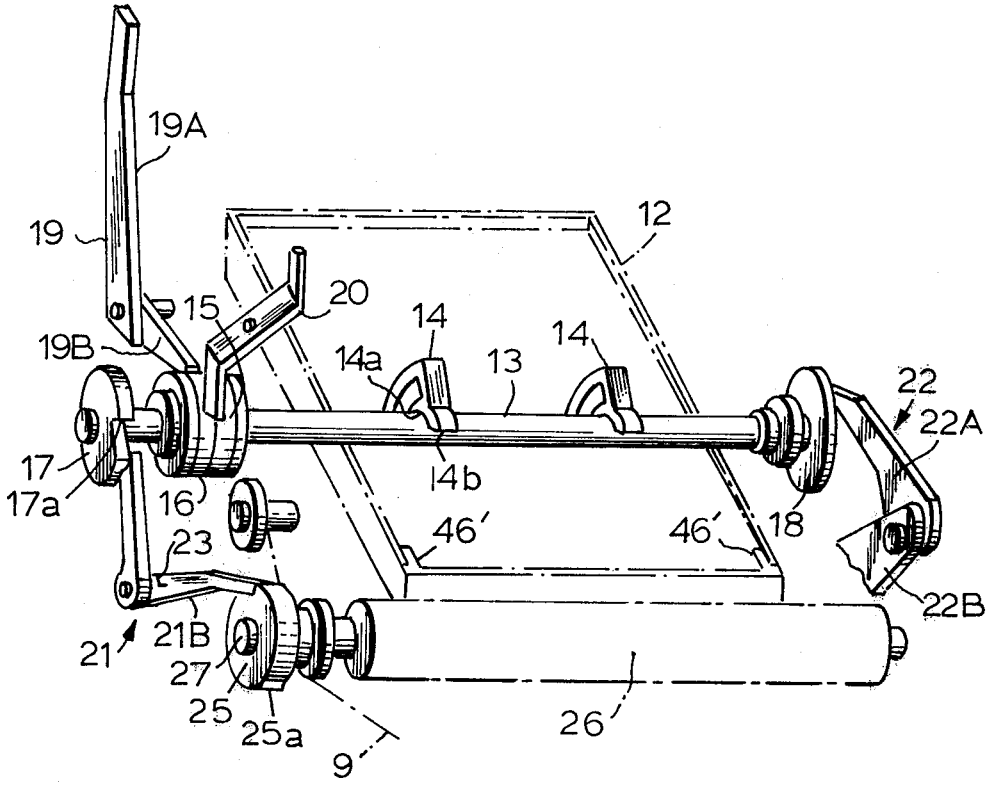
FIG. 2 is a perspective view of a main shaft, paper feeding members, cams, arms and a lever in the copying machine as shown in FIGS. 1*a* and 1*b*.
Figure 3A:
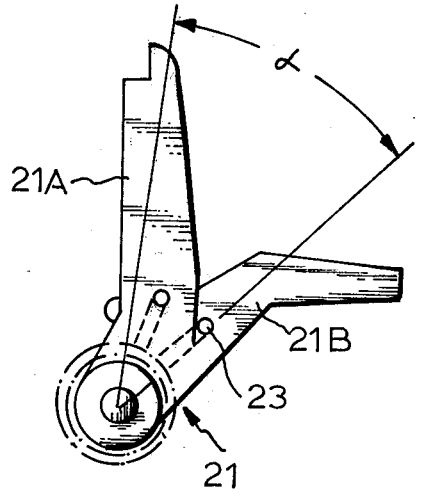
FIGS. 3*a* and 3*b* are a side elevational view and a perspective view, respectively, of a second V-shaped arm.
Figure 3B:
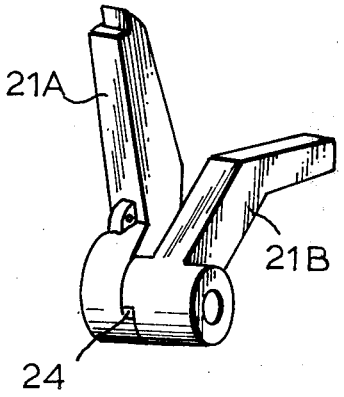
Figure 4:
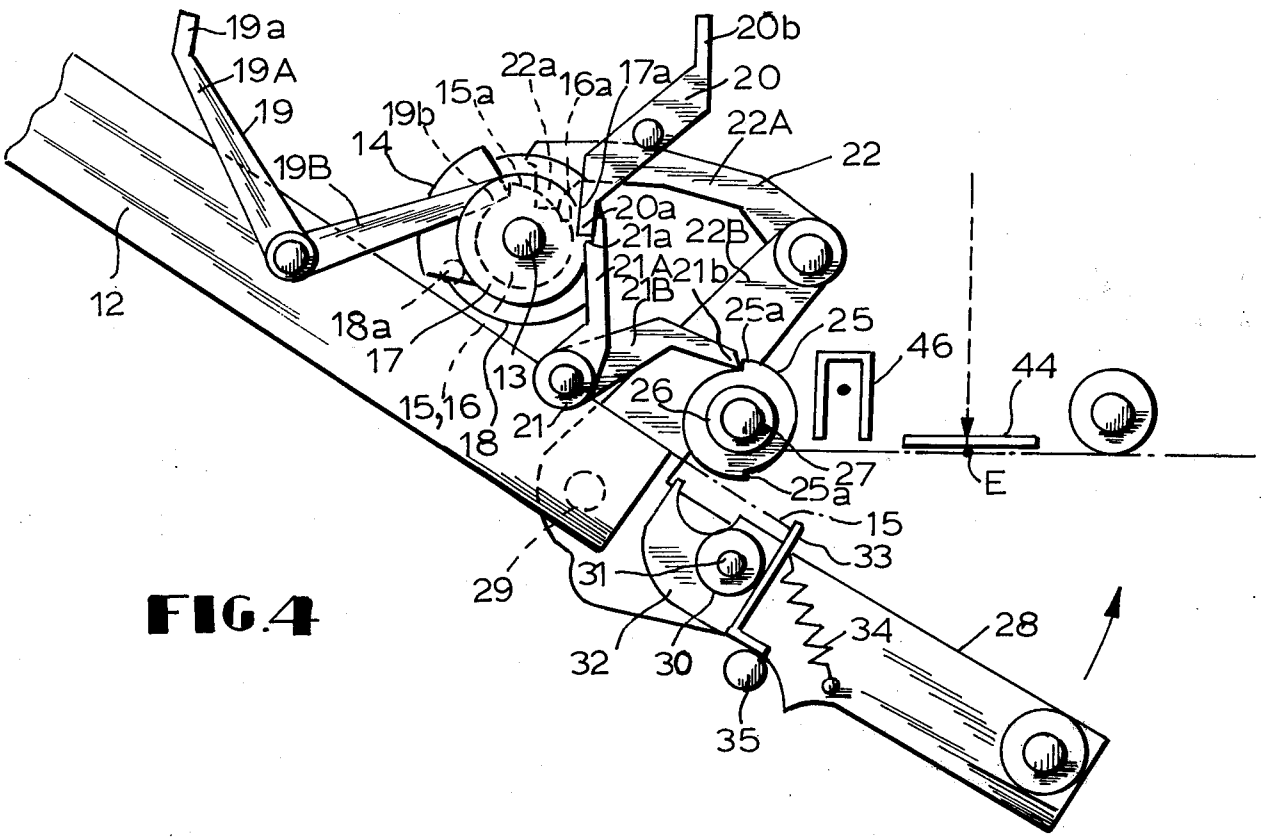
FIGS. 4 and 5 are enlarged side elevational views of the paper feeding members, cams, arms, lever and oscillatory frame in action prior to and after the copying operation.

Reference numeral 13 denotes a main shaft for feeding copying paper, and the main shaft 13 is provided in a portion of the machine body 2 that is above the lower end (from which the copying paper is fed) of the cassette 12. As is clearly shown in FIG. 2, a plurality of substantially fan-shaped paper feeding members 14 having a suitable degree of elasticity and made of, for example, rubber are mounted on the central portion of the main shaft 13. The fan-shaped paper feeding members 14 have in their base portions a mounting recess 14*a* and a cut surface 14*b* so that they are detachably and position-adjustably fitted on the main shaft 13. In the paper feeding arcuate surface of the members 14 is provided a plurality of friction-producing grooves so that the copying paper in the cassette is accurately fed. On one end portion of the main shaft 13, cams 15, 16 and 17 are mounted, and, on the other end portion thereof, a disc 18 having a projection 18*a* at one point on the peripheral side surface thereof is mounted. At the end of the main shaft 13 on which the cams 15, 16 and 17 are mounted are further provided a first substantially V-shaped arm 19, a substantially Z-shaped arm 20 and a second substantially V-shaped arm 21 which are engaged with the cams 15, 16 and 17, respectively, and these arms 19, 20 and 21 are pivotally connected to the machine body 2. At the end of the main shaft 13 on which the disc 18 is mounted is provided a slightly bent flexible lever 22 which is engageable with the disc 18, and this lever 22 is pivotally connected to the machine body 2. The first V-shaped arm 19 consists of a pair of arm portions 19A and 19B which are firmly connected to each other. The second V-shaped arm 21 consists of a pair of arm portions 21A and 21B which are pivotally connected to each other as shown in FIGS. 3-*a* and 3-*b*. These arm portions 21A and 21B are normally kept at a predetermined angle $\alpha$ by a spring 23 provided therebetween, and they can be kept loose due to the spring 23 and a gap 24 between the pivotally movable portions thereof. The lever 22 consists of a first lever portion 22A having a hook 22*a* at the front end portion thereof, and a second lever portion 22B pivotally connected thereto as shown in FIG. 4. The second lever portion 22B is pivotally connected to the machine body 2 at a pivot 29. The lever 22 is normally kept at a predetermined angle by a spring (not shown) provided between the lever portions 22A and 22B. FIG. 4 shows a principal portion of the embodiment prior to the feeding of copying paper. In this stage, the end 19*b* of the arm portion 19B of the first V-shaped arm 19 is engaged with an engagement portion 15*a* of the cam 15 to thereby prevent the main shaft 13 from being rotated. One end 20*a* of the Z-shaped arm 20 is engaged with the cam 16 at a portion thereof which is spaced from an engagement portion 16*a* as shown in FIG. 4. When the cam 16 is rotated, end 20*a* of the Z-shaped arm 20 is engaged with the engagement portion 16*a* to stop the rotation of the cam 16. The end 21*a* of the arm portion 21A of the second V-shaped arm 21 opposed to the cam 17 is engaged with the cam 17 at a portion thereof that is spaced from the engagement portion 17*a*, while the end 21*b* of the other arm portion 21B is engaged with an engagement portion 25*a* of a cam 25 which will be described later. The hook 22*a* on the first lever 22A which constitutes the slightly bent lever 22 is not engaged, when the machine is not in operation or in the state as shown in FIG. 4), with the projection 18*a* on the disc 18, which is opposed to the lever 22. The cam 25 is mounted on one end portion of a shaft 27 on which a copying paper driving roll 26 is mounted. The shaft 27 is supported on the machine body 2 in bearings and driven by the chain 9 via a one-way clutch. The cam 25 used in this embodiment has two engagement portions 25*a* in diametrically opposite positions thereon.

Figure 5:
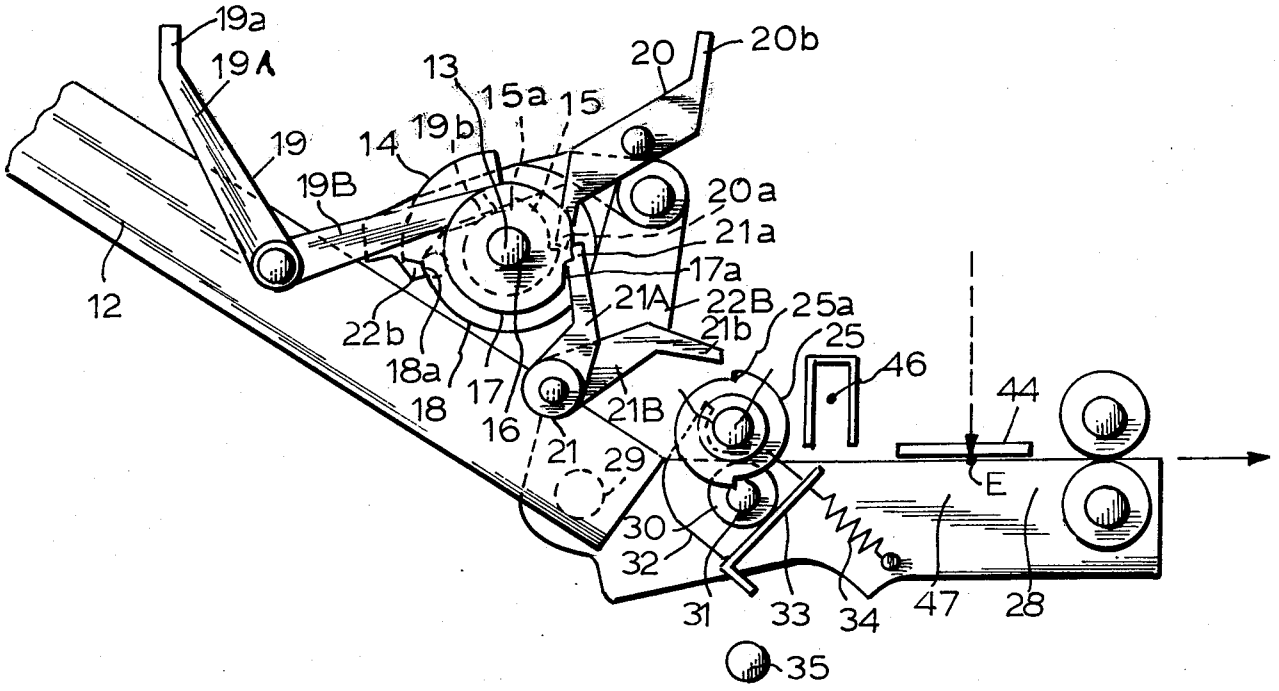
Figure 6:
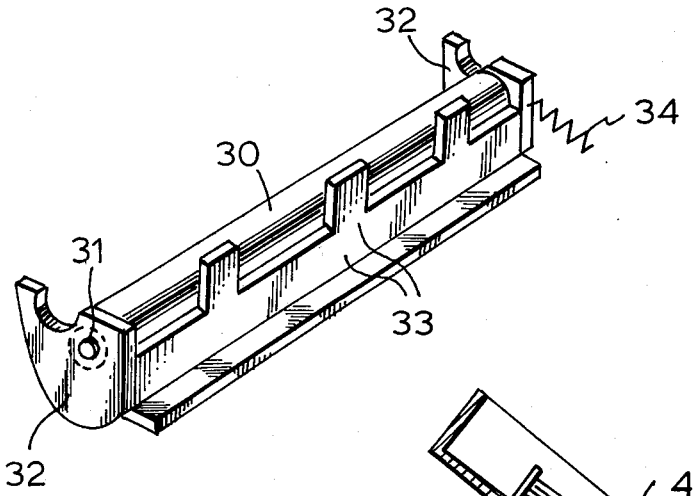
FIG. 6 is a perspective view of a stopper.
Figure 7A:
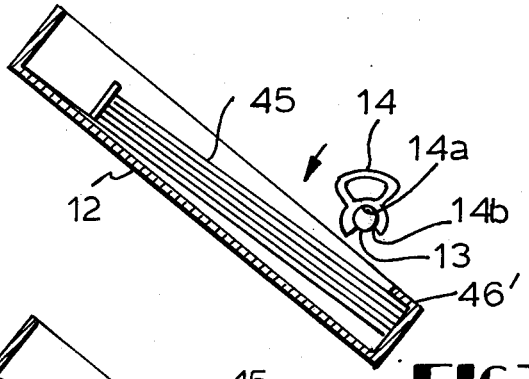
FIGS. 7*a*–7*d* are sectional side elevational views of copying paper with paper feeding members in each stage of action thereof.
Figure 7B:
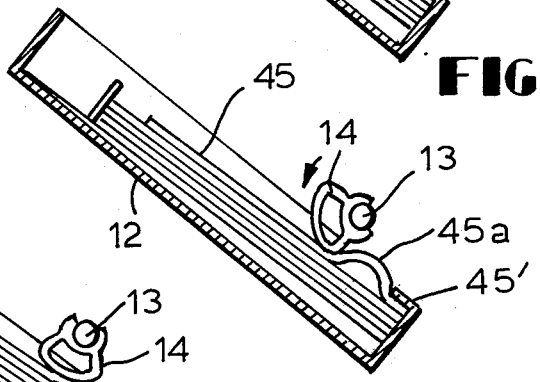
Figure 7C:
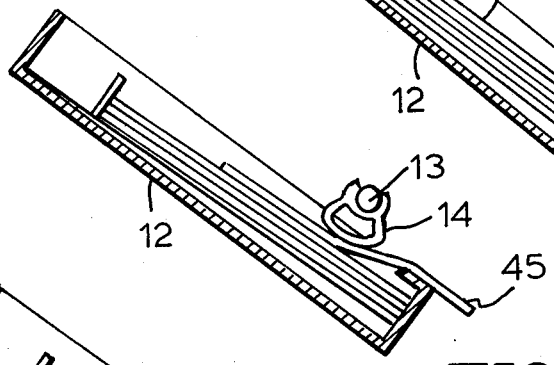
Figure 7D:
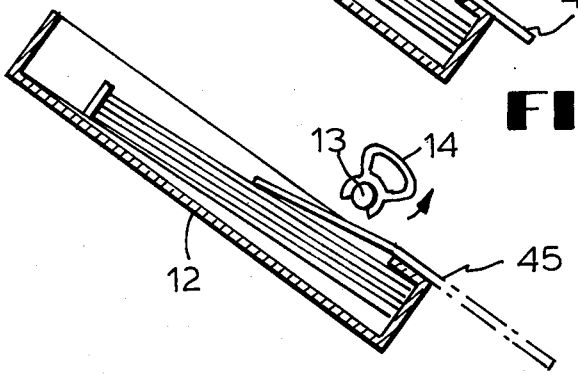

Reference numeral 28 denotes an oscillatory frame integral with the second lever portion 22B which constitutes the slightly bent lever 22, and the oscillatory frame 28 can be oscillated by the second lever portion 22B about the pivot 29 for the lever 22B. The oscillatory frame 28 is provided with a shaft 31 in a bearing, and a driven roll 30 opposed to the copying paper driving roll 26 is mounted on the shaft 31. On both end portions of the shaft 31, are rotatably mounted stop mounting members 32, as shown in FIG. 6. On the front end surfaces of the stop mounting members 32 is secured a substantially L-shaped cross-section stop 33, which extends parallel to the driven roll 30. Between the stop 33 and a fulcrum pin provided on the oscillatory frame 28 is connected a spring 34, and the lower end portion of the stop 33 is supported by a bar 35 secured to the machine body 2 when the oscillatory frame 28 is inclined as shown in FIG. 4. When the disc 18 is rotated with the projection 18*a* engaged with the hook 22*a* of the lever 22, the second level portion 22B is rotated from the position as shown in FIG. 4 to rotate the lever 22 counter-clockwise about the pivot 29 and the oscillatory frame 28 is thereby oscillated in the same direction about the pivot 29 to a substantially horizontal position as shown in FIG. 5. When the frame 28 is thus oscillated, the shaft 31 for the driven roll 30 and the stop mounting members 32 are moved to higher positions. Consequently, the upper end of the stop 33 is pulled by the spring 34 so as to be rotated in a direction opposite to that in which the frame 28 is oscillated. The stop 33 thus falls frontwardly so that it does not project into the path of copying paper (refer to FIG. 5).

Referring again to FIGS. 1-*a*, 1-*b* and 2, the frame 3 movable with the mount 1 for the original is provided at the lower end portion thereof with an operating member 36 pivotally connected thereto, and which is engagable with tips 19*a* and 20*b* of the arms 19 and 20. The operation member 36 can be pivoted clockwise only when the frame 3 is moved to the right in the figures, and it is prevented by a restricting member 37 and being pivoted in the opposite direction.

Figure 1B:
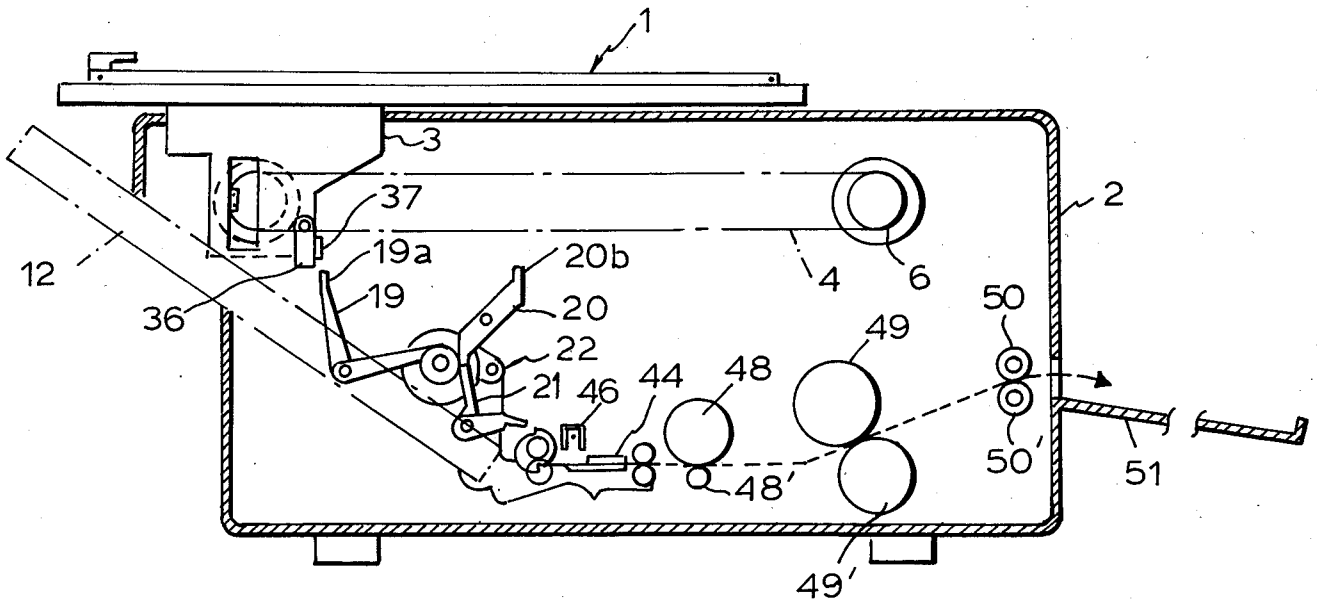

Referring to FIG. 1*a*, reference numeral 38 denotes a lamp. The light from the lamp 38 is passed through the original-irradiating portion 39 in the upper portion of the machine body 2 so as to irradiate the original placed on the mount 1, and an image of the original enters an exposure window 44 above the path B of copying paper after being reflected from a first mirror 40, an in-mirror lens 41, and a second mirror 43. The image of the original is thus reflected onto the copying paper. Reference symbol I denotes an irradiation starting point in the cycle A of movement of the mount 1, and E designates an exposure starting point in the path B of the copying paper. The irradiation starting point I and exposure starting point E coincide optically with each other when exposure is started.

The operation of the embodiment having the above-described construction will be described.

When a power source (not shown) is turned on to energize the drive motor 11 and thereby drive the chains 9 and 10 by turning on a print button (not shown), the sprocket 6 is rotated by a clutch and the chain 4 is driven. When the chain 4 is thus driven, the frame 3 which is in the position (stopping position) as shown in phantom lines in FIG. 1-*a* begins to be moved leftward. At this time, the mount 1 for original beings to be moved leftward from the predetermined stopping point S in the cycle of movement thereof (exposure preparation stage). Before the mount 1 has started to be moved, and, it starts to be moved as described above, the copying paper feeding members 14, cams 15, 16 and 17, arms 19, 20 and 21, lever 22, disc 18, and oscillatory frame 28 are in the positions as shown in FIGS. 2 and 4. When the mount 1 comes to the end of the exposure preparation stage, the operating member 36 pivotally connected to the movable frame 3 engages the end 19*a* of the arm portion 19A of the first V-shaped arm 19. Thereby the end 19*b* of the arm portion 19B, which has been engaged with the engagement portion 15*a* of the cam 15, is disengaged therefrom so as to allow the paper feeding main shaft 13 to be rotated. When the main shaft 13 is rotated, the members 14 mounted thereon are also rotated together to start the feeding of copying paper 45 stacked in the cassette 12. The time starting with the initiation of movement of the mount 1 and ending with the initiation of feeding of copying paper 45 is designated as $To_1$. The feeding of copying paper will be described with reference to FIGS. *7a–7d*. When the main shaft 13 is stopped, the arcuate surfaces of the paper feeding members 14 are out of contact with the copying paper as shown in FIG. *7a*. When the main shaft 13 is rotated, the paper feeding members 14 are rotated together in the direction of the arrow and the arcuate surfaces thereof contact the uppermost sheet of copying paper 45 in the cassette 12 and due to the frictional force of the members 14 the front end portion of the copying paper 45 is bent up in an arcuate shape as shown in FIG. *7b* with the front edge of the paper 45 being held by claws 46'. When the paper feeding members 14 are further rotated, the front end of the sheet of paper 45 is released from the claws 46' and the sheet is caused to slide out of the cassette 12 as shown in FIG. *7c*. By the time the paper feeding members 14 rotate out of contact with and move away from the uppermost sheet of copying paper 45, the sheet of paper 45 has advanced to a position extent as shown in FIG. *7d*. The sheet of paper 45 is thereafter further advanced by the acceleration given thereto by the members 14 and by gravity due to its own weight, so that the front end portion of the sheet of paper 45 is passed between the paper driving roll 26 and driven roll 30 provided on the oscillatory frame 28 an impinging upon the stop 33 so as to be caused to stand by for a while. The rotation of the paper feeding members 14 is stopped when the members 14 are in position as shown in FIG. *7d*.) After the uppermost sheet of copying paper 45 in the cassette 12 has been released from the claws 46' by the rotation of the paper feeding members 14, the sheet of paper 45 is moved to a predetermined position by its own inertia and weight. The sheet of copying paper 45 is fed in the manner as described above by the rotation of the main shaft 13 and paper feeding members 14. When the main shaft 13 starts rotating, the disc 18 which has been in the position as shown in FIG. 4 is also rotated. Thereupon, as shown in FIG. 5, the projection 18*a* is engaged with the hook portion 22*a* at the end of the lever 22 so as to rotate the lever 22 counterclockwise about the pivot 29 by means of the second lever portion 22B forming part of the lever 22. When the lever portion 22B is pivoted rotated, the oscillatory frame 28 is upwardly pivoted. As the frame 28 is pivoted to a horizontal position, the stop 33 is pulled by the spring 34 and falls in the frontward direction so that the front end of the sheet of copying paper 45, which has been abutting the stop 33, is released. The sheet of paper 45 is then transferred by being nipped between the paper driving roll 26 and the driven roll 30. When a predetermined period of time has elapsed after the copying paper 45 is fed by the paper feeding members 14 so that the front end abuts the stop 33, the stop 33 falls in the frontward direction as the frame 28 is upwardly pivoted. Consequently, the copying paper 45 stands by for this predetermined period of time while the front end thereof is in contact with the stop 33. In the meantime, the second V-shaped arm 21 is in the position as shown in FIG. 4 when the main shaft 13 is stopped. When the end 21*a* of the arm portion 21A is disengaged from the engagement portion 17*a* of the cam 17 and when the end 21*b* of the arm portion 21B is engaged with the engagement portion 25*a* of the cam 25, the rotation of the copying paper driving roll 26 is stopped. However, after the cam 17 makes almost one complete rotation (during which, the feeding of the paper 45 is carried out) in accordance with the rotation of the main shaft 13 which is released by the first V-shaped arm 19, the V-shaped arm 21 is pivoted counterclockwise when the end 21*a* of the arm portion 21A of the second V-shaped arm 21 is engaged with the engagement portion 17*a* of the cam 17, and thereby the end 21*b* of the arm portion 21B is disengaged from the engagement portion 25*a* of the cam 25. Thereupon, the rotation of the paper driving roll 26 is started. The rotation of the paper driving roll 26 is started when the oscillatory frame 28 is raised to a substantially horizontal position. This can be clearly understood from FIG. 5. When the oscillatory frame 28 reaches a horizontal position so that the driven roll 30 is close to the paper driving roll 26, the lower end 20*a* of the Z-shaped arm 20 is engaged with the engagement portion 16*a* of the cam 16 to thereby prevent the main shaft 13 from being rotated. As a result, the lever 22 is held in the highest position by the projection 18*a* on the disc 18 (refer to FIG. 5). By the time the oscillatory frame 28 has reached a horizontal position so that the driving roll 26 and driven roll 30, the rotation of which was just started, come close to each other, the stop 33 falls frontwardly to release the copying paper 45. When the rolls 26 and 30 come close to each other, the copying paper 45 begins to be further transferred by being nipped between these rolls 26 and 30. The period of time from the starting of the transfer of the copying paper 45 by the paper feeding members 14 to the restarting of the transfer of the copying paper 45 by the paper driving roll 26 and driven roll 30 is designated $To_2$. The sum of $To_2$ and the above described $To_1(To_1+To_2)$ equals $T_1$. $To_1$ may be abitrarily set.

The copying paper 45 is passed through a charged region provided with a charging means 46 and reaches the exposure starting point E in the exposure portion 47 after time a period of time $T_2$ has elapsed after the paper 45 begins to be transferred from the point where it contacts the stop 33 in the stand by position, i.e. after a time a period of time $To_2+T_2$ has elapsed after the feeding of the paper 45 was started by the paper feeding members 14, or a period of time $T_1+T_2$ has elapsed after the movement of the mount 1 for the original was started. The mount 1 for original reaches the irradiation starting point I at the same time that the copying paper 45 reaches the exposure starting point E, and the front end of the original and of the copying paper are optically aligned with each other by the above-described optical system. At this time, the copying paper 45 beings to be transferred synchronously with the mount 1 at a predetermined rate so as to carry out the exposure of the paper 45. The copying paper 45 the exposure of which has been finished is passed through developing rolls 48 and 48', fixing rolls 49 and 49', and discharge rolls 50 and 50' disposed at the end portion of the path B of the paper 45 so as to be discharged onto a copying paper receiver 51 provided outside the machine body 2. The mount 1 which has passed the irradiation starting point I is further transferred to the right (exposure stroke) in FIG. 1. The movement of the mount 1 is then reversed at the right end of the exposure stroke and it is moved to left (returning stroke) in the drawing. When the operating member 36 provided on the lower end portion of the movable frame 3 acts on the upper end **20*b* of the Z-shaped arm 20 during the returning stroke, the arm 20 is rotated about the pivot thereof, and the lower end 20*a* of the arm 20, which has been engaged with the engagement portion 16*a* of the cam 16 to prevent the main shaft 13 from being rotated is disengaged therefrom to allow the main shaft 13 to be rotated again. When the main shaft 13 or the disc 18 is rotated, the projection 18*a* provided on the disc 18 is disengaged from the hooking portion 22*a* at the end of the lever 22. As a result, the lever 22 is returned to its original position as shown in FIG. 4, and, at the same time, the oscillatory frame 28 is returned to its original position where it is inclined. In this case, the angle of rotation of the main shaft 13 is so small that it is just sufficient to disengage the hook 22*a* of the lever 22 from the projection 18*a* of the disc 18. Thereupon, the end 19*b* of the arm portion 19B of the first V-shaped arm 19 is immediately engaged with the engagement portion 15*a* of the cam 15 to stop the rotation of the main shaft 13. Thus, the copying machine is returned to the initial condition as shown in FIG. 4, in which it is ready for feeding the next sheet of copying paper. When copies are continuously made, the above-described operation is repeated. A desired number of copies can be made under control of to a counter (not shown) provided in the copying machine. After a copying operation has been completed, the mount 1** for original is always stopped at the stopping point S in the path thereof.

When the copying paper 45 is to be fed by hand, the cassette 12 is lowered to the lower position as shown in phantom lines in FIG. 12. Then, the paper 45 may be fed by hand while using the cassette 12 as a guide, so that the front end of the paper 45 is contacted with the stop 33. A print button is thereafter pressed to transfer the paper 45 synchronously with the original, and the remaining part of the operation is the same as described above.

According to the method and apparatus of the present invention, the construction of which is as described above, the original and copying paper can be synchronously transferred by a mechanical means unlike a conventional method and apparatus in which an electrical means using a detecting means, such as a limit switch is employed. Therefore, the method of the present invention makes unnecessary a complicated connection of electric wires. Moreover, it permits reducing the cost of manufacturing the copying machines owing to the simple construction thereof and makes carrying out inspections easy during the maintenance thereof.

We claim:

1. An apparatus for synchronously transferring an original and a sheet of copying paper for electrostatic photo-duplication, said apparatus comprising a mount for holding the original, said mount being mounted for reciprocal movement in said apparatus in a plane parallel to the plane of the original, a driving mechanism connected to the mount for reciprocating the mount at a predetermined speed, means for directing light at an irradiation point along the path of reciprocation of said mount, paper transfer means for feeding a sheet of copy paper along a copying paper transfer path in said apparatus, exposure means at an exposure point along said transfer path spaced from said paper feeding means in the direction of paper feed, image reflecting means for directing the image from said irradiation point to said exposure point, for optically aligning the exposure point with said irradiation point, paper edge engaging means positioned along said paper transfer path between said transfer means and said exposure point, said paper edge engaging means being movable into and out of the transfer path, said paper transfer means normally being in a condition in which it does not transfer copying paper, and said paper edge engaging means normally being in the transfer path of the copying paper, and operating means connected to said paper transfer means and said paper edge engaging means and actuated in response to movement of said mount for changing the condition of said paper transfer means to a condition for transferring paper and for simultaneously moving said paper edge engaging means out of the copying paper transfer path when said mount has reached a predetermined position along the path of movement thereof at which position the time for the leading edge of the original to reach the irradiation point from said predetermined position is the same as the time for the leading edge of the copying paper to be fed from said edge engaging means to said exposure point.

2. An apparatus as claimed in claim 1 in which said operating means includes a member projection into the path of movement of said mount at said predetermined position along the path of movement of the mount for actuating said operating means.

3. An apparatus as claimed in claim 1 in which said paper transfer means comprises a fixed roll means above the copying paper transfer path and a movable roll means below the transfer path and movable toward and away from said fixed roll means, and said operating means comprises a roll moving means connected to said movable roll means for moving said movable roll means from a normal position spaced from said fixed roll means toward and away from a position in which the movable roll means can nip a sheet of copying paper between it and said fixed roll means.

4. An apparatus as claimed in claim 3 in which said movable roll means comprises a frame member pivoted at a point adjacent the copying paper transfer path and pivotable toward and away from said fixed roll means, and a movable paper transfer roll mounted on said frame member, and said paper edge engaging means comprises a paper edge engaging member pivotally mounted on said frame and means engaging said paper edge engaging member normally pivoting it to an upright position transverse to the length of the frame, and spring means connected to said paper edge engaging member normally exerting a tension on said paper edge engaging member tending to pivot it to an angular position on said frame member in which it is out of the copying paper transfer path and said paper edge engaging means is free of said means engaging said paper edge engaging member, said roll moving means comprising a member for pivoting said frame toward said fixed roll means.

5. An apparatus as claimed in claim 1 further comprising a supply means for holding a supply of sheets of copying paper, paper feed means positioned adjacent said supply means for engaging one sheet of the supply of sheets at a time and feed it generally in the direction of the plane of the sheet of paper along said copying paper transfer path toward said paper transfer means and for moving the leading edge of the sheet of copying paper against said paper edge engaging means, and said operating means is connected to said paper feed means and is actuated in response to the movement of said mount for actuating said paper feed means and, after a delay, subsequently changing the condition of said paper transfer means when said mount has reached a predetermined position along the path of movement thereof at which the time for the leading edge of the original to reach the irradiation point is the same as the time for the leading edge of the copying paper to be fed from said supply means to said paper edge engaging means, held at said paper edge engaging means and then fed from said paper edge engaging means to said exposure point.

6. An apparatus as claimed in claim 5 in which said operating means includes a member projecting into the path of movement of said mount at said predetermined position along the path of movement of the mount for actuating said operating means.

7. An apparatus as claimed in claim 5 in which said paper transfer means comprises a fixed roll means above the copying paper transfer path and a movable roll means below the transfer path, and a frame member pivoted at a point adjacent the transfer path and pivotable toward and away from said fixed roll means and on which said movable roll is mounted, and said paper edge engaging means comprises a paper edge engaging member pivotally mounted on said frame and means engaging said paper edge engaging member normally pivoting it to an upright position transverse to the length of the frame, and spring means connected to said paper edge engaging member normally exerting a tension on said paper edge engaging member tending to pivot it an angular position on said frame member in which it is out of the copying paper transfer path and said paper edge engaging means is free of said means engaging said paper edge engaging member, and said supply means is positioned for feeding the sheets of copying paper along said frame member when it is in its downwardly pivoted position for causing said sheets to move between said roll means and against said paper edge engaging member due to inertia of the sheet of copying paper and the effect of gravity thereon, said operating means comprising a member connected to said frame member for pivoting it toward and away from said fixed roll means.

* * * * *